US005608198A

United States Patent [19]

Clark et al.

[11] Patent Number: 5,608,198

[45] Date of Patent: Mar. 4, 1997

[54] CIRCUIT BREAKER ARRANGEMENT FOR PROTECTION AGAINST ELECTRICAL ARCS

[75] Inventors: Robert J. Clark; Greg Ghere; Jeffrey M. Kaufman; Terry D. Repstien; Willard J. Rezac; Steven C. Wilgenbusch, all of Cedar Rapids, Iowa

[73] Assignee: Square D Company, Palatine, Ill.

[21] Appl. No.: 494,754

[22] Filed: Jun. 26, 1995

[51] Int. Cl.[6] ..... H01H 9/32; H01H 33/04

[52] U.S. Cl. ..... 218/147; 218/148; 218/149; 218/156; 218/158

[58] Field of Search ..... 200/305, 306; 218/146, 147, 148–151, 152, 155–158; 335/16, 147, 195, 196, 201, 202

[56] References Cited

U.S. PATENT DOCUMENTS

| | | | |
|---|---|---|---|
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,417,223 | 11/1983 | Bancalari | 335/195 |
| 4,453,053 | 6/1984 | Yamagata et al. | 335/201 X |
| 4,511,774 | 4/1985 | Forsell | 218/30 |
| 4,550,300 | 10/1985 | Jencks et al. | 335/16 |
| 4,585,912 | 4/1986 | Fischer et al. | 218/158 |
| 4,612,427 | 9/1986 | Mori et al. | 218/148 |
| 4,672,157 | 6/1987 | Neel et al. | 218/150 |
| 4,740,768 | 4/1988 | Morris et al. | 335/22 |
| 4,772,768 | 9/1988 | Nukada | 200/305 |
| 4,864,263 | 9/1989 | Castonuay et al. | 375/167 |
| 4,970,481 | 11/1990 | Arnold et al. | 335/201 X |
| 4,975,553 | 12/1990 | Oster | 218/34 |
| 5,003,139 | 3/1991 | Edds et al. | 200/401 |
| 5,073,764 | 12/1991 | Takahashi et al. | 218/147 X |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,210,385 | 5/1993 | Morel et al. | 200/337 |
| 5,245,302 | 9/1993 | Brune et al. | 335/35 |
| 5,304,761 | 4/1994 | Rosen et al. | 218/157 |
| 5,481,235 | 1/1996 | Heise et al. | 335/18 |

*Primary Examiner*—J. R. Scott

*Attorney, Agent, or Firm*—Larry I. Golden; Kareem M. Irfan

[57] ABSTRACT

An arrangement in an electrical switching device for protection against electrical arcs comprises a tripping mechanism, a stationary contact carrier, a movable contact carrier, an exhaust vent, an arc runner, and an arc extinguishing barrier. The stationary contact carrier has a stationary contact mounted thereon, and the movable contact carrier has a movable contact mounted thereon. In response to an overcurrent condition, the tripping mechanism causes the movable contact carrier to rotate from a closed position to an open position, thereby generating an electrical arc. In the closed position the movable contact abuts the stationary contact, and in the open position the movable contact is separated from the stationary contact. The arc extinguishing barrier is composed of an outgassing material and is located between the stationary contact and a portion of the tripping mechanism. The stationary contact is located generally between the portion of the tripping mechanism and the arc runner such that the arc runner draws the electrical arc away from the portion of the tripping mechanism. The exhaust vent is located generally in line with the initial direction of movement of the movable contact when the movable contact carrier begins rotating from the closed position to the open position.

2 Claims, 4 Drawing Sheets

CIRCUIT BREAKER ARRANGEMENT FOR PROTECTION AGAINST ELECTRICAL ARCS

FIELD OF THE INVENTION

The present invention relates generally to miniature circuit breakers and, more particularly, to an arrangement for protecting a movable contact carrier, a stationary contact carrier, and tripping mechanism of a miniature circuit breaker from electrical arcs generated during circuit interruption.

BACKGROUND OF THE INVENTION

Miniature circuit breakers are commonly used for providing automatic circuit interruption upon detection of undesired overcurrent conditions on the circuit being monitored. These overcurrent conditions include, among others, overload conditions, ground faults and short-circuit conditions.

Miniature circuit breakers typically include an electrical contact mounted on a movable contact carrier which rotates away from a stationary contact in order to interrupt the current path. The contact carrier is pivotally mounted to a rotatable blade housing, and a spring is used to bias the movable contact toward the stationary contact during normal current conditions. The type of overcurrent condition dictates how quickly the contact carrier must rotate away from the stationary contact. For example, in response to overcurrent conditions at relatively low magnitudes but present for a long period of time, circuit breakers generally employ a tripping mechanism to rotate the blade housing carrying the contact carrier. Since the contact carrier rotates with the blade housing, the contact on the movable contact carrier is forced away from the stationary contact. In response to overcurrent conditions at relatively high magnitudes, circuit breakers must break (or blow-open) the current path very quickly, reacting much faster than the reaction time for the tripping mechanism. In this case, the contact carrier rotates to an open position prior to actuation of the tripping mechanism.

When the electrical contact on the movable contact carrier separates from the stationary contact in response to an overcurrent condition, undesired arc energy develops between the separating contacts because of their voltage differential. This arc energy may be characterized as a discharge of electricity through a gas, where the voltage differential between the separating contacts is approximately equal to the ionization potential of the gas. The arc energy is undesirable because it has a tendency to flow back or collapse back into the gap separating the contacts, thereby exposing the movable contact carrier and the stationary contact carrier to the arc energy. The movable contact carrier and stationary contact carrier may be eroded, melted, or vaporized when exposed to the arc energy without some sort of protective device. If one or both of the contact carriers are damaged to the extent that there is an excessive reduction in their cross-sectional area, the contact carriers could fail to properly interrupt the circuit in response to an overcurrent condition. The arc energy is also undesirable because it has a tendency to flow toward the tripping mechanism of the circuit breaker, where the arc energy can damage the components of the tripping mechanism. One component of the tripping mechanism which is susceptible to damage is the toggle spring, which is often detachably connected at one end to a hook on the movable contact carrier. Without some sort of protective device, the arc energy can fuse the toggle spring to the carrier hook or cause the toggle spring to anneal and thereby loose its elasticity.

Accordingly, there is a need for an arrangement for protecting a movable contact carrier, a stationary contact carrier, and a tripping mechanism of a miniature circuit breaker from arc energy generated during a circuit interruption.

SUMMARY OF THE INVENTION

In one particular embodiment, a circuit breaker arrangement comprises a tripping mechanism, a stationary contact carrier, a movable contact carrier, an exhaust vent, an arc runner, and an arc extinguishing barrier. The stationary contact carrier has a stationary contact mounted thereon, and the movable contact carrier has a movable contact mounted thereon. In response to an overcurrent condition, the tripping mechanism causes the movable contact carrier to rotate from a closed position to an open position, thereby generating an electrical arc. In the closed position the movable contact abuts the stationary contact, and in the open position the movable contact is separated from the stationary contact.

The arc extinguishing barrier is composed of an outgassing material and is located between the stationary contact and a portion of the tripping mechanism. The stationary contact is located generally between the portion of the tripping mechanism and the arc runner such that the arc runner draws the electrical arc away from the portion of the tripping mechanism. The exhaust vent is located generally in line with the initial direction of movement of the movable contact when the movable contact carrier begins rotating from the closed position to the open position.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
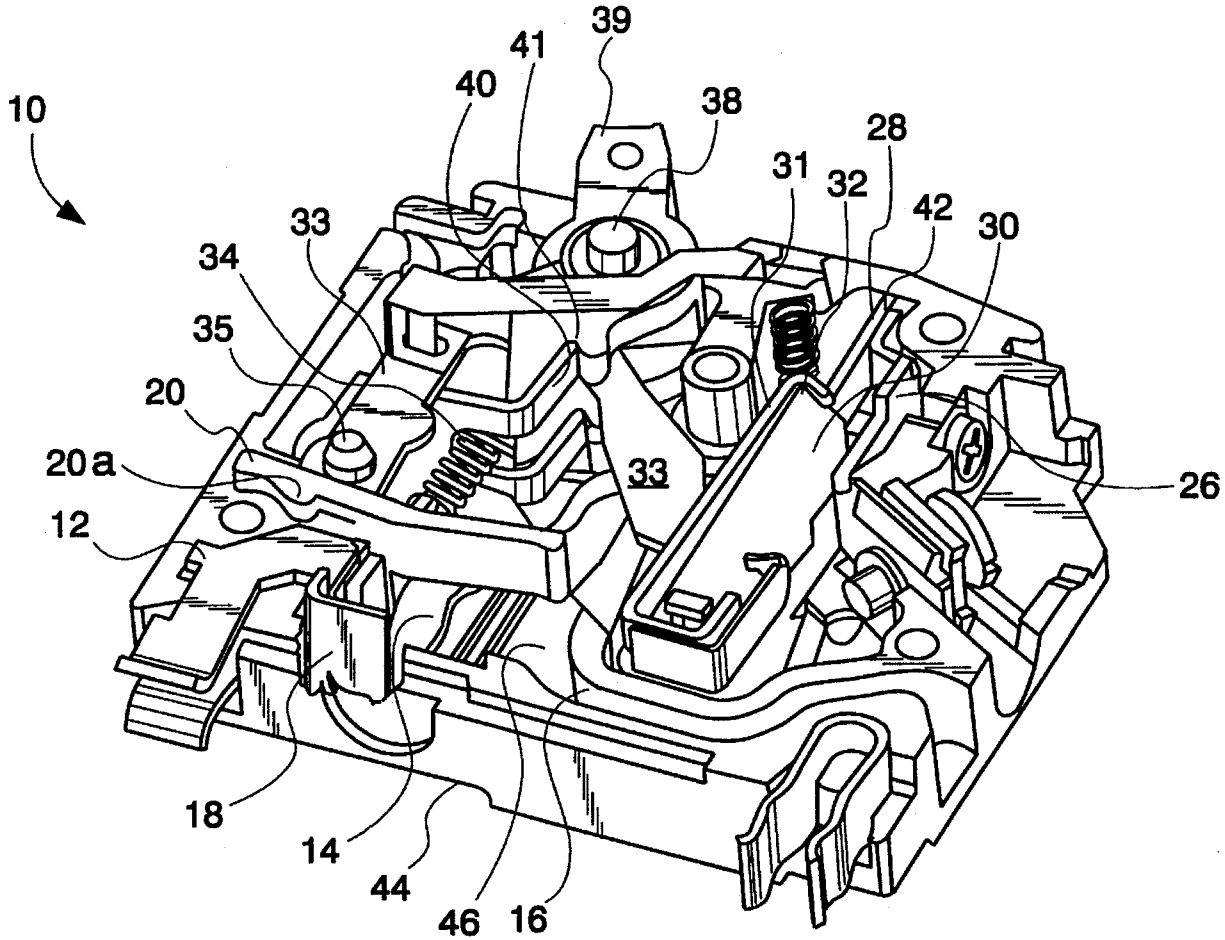
FIG. 1 is an isometric view of a circuit breaker embodying the present invention.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
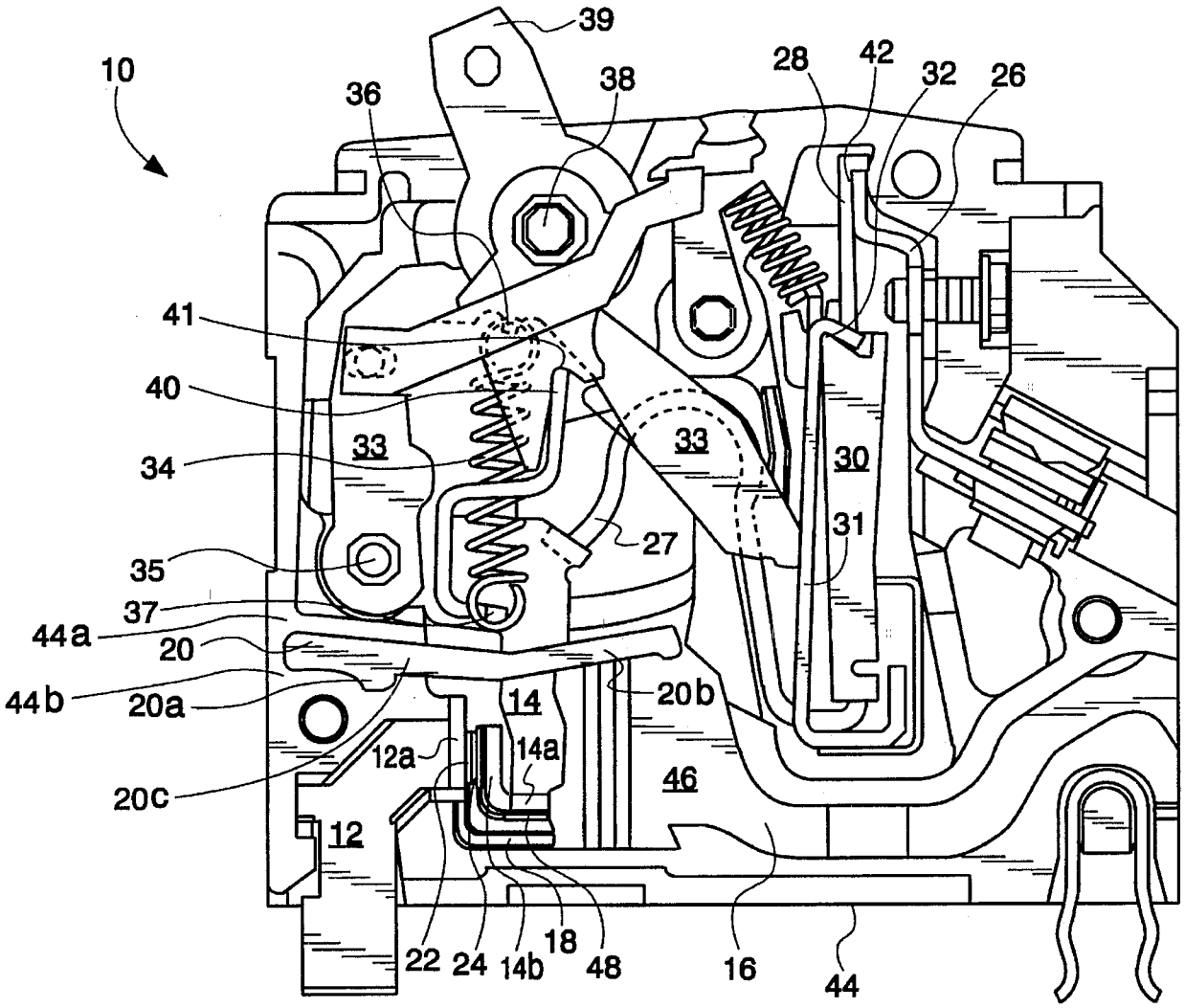
FIG. 2 is a top view of the circuit breaker in FIG. 1.

Turning now to the drawings, FIGS. 1 and 2 illustrate a circuit breaker 10 designed to protect the components thereof from arc energy generated during a circuit interruption. The circuit breaker 10 comprises a tripping mechanism, a stationary contact carrier 12, a movable contact carrier 14, an exhaust vent 16, an arc runner 18, and an arc extinguishing barrier 20. The stationary contact carrier 12 has a stationary contact 22 mounted thereon, and the movable contact carrier 14 has a movable contact 24 mounted thereon. In response to a magnetic-type or thermal-type overcurrent condition, the tripping mechanism causes the movable contact carrier 14 to rotate from a closed position (FIG. 3) to an open position (FIG. 4), thereby generating an electrical arc. In the closed position (FIG. 3) the movable contact 24 abuts the stationary contact 22, and in the open position (FIG. 4) the movable contact 24 is separated from the stationary contact 22.

The current path through the circuit breaker 10 extends from a line terminal formed by the stationary contact carrier 12 to a load terminal 26. Current flows from the line terminal to the movable contact carrier 14 via the stationary and movable contacts 22 and 24. From the movable contact carrier 14, a flexible conductor (or pigtail) 27 connects the current path to a bimetal 28 which, in turn, is conductively connected to the load terminal 26. Current flows out of the load end of the circuit breaker via a terminal block of the load terminal 26.

As the construction and operation of the tripping mechanism is fairly conventional, it is not described in detail herein. It suffices to state that the circuit breaker is of a thermal/magnetic type. In a magnetic trip the tripping mechanism operates in response to the current flow through the circuit breaker reaching a specified level. The elevated current level causes a high magnetic flux field around a yoke 30 to draw a magnetic armature 31 toward the yoke 30. The magnetically-drawn armature 31 rotates counterclockwise about an armature pivot 32. In response to the counterclockwise rotation of the armature 31, a trip lever 33 is released from its engagement within a latching window (not shown) formed by the armature 31. The release of the trip lever 33 allows a toggle spring 34 to rotate the trip lever 33 clockwise about a trip lever post 35. One end of the toggle spring 34 is connected to a trip lever hook 36, while the other end of the toggle spring 34 is connected to a carrier hook 37.

Figure 4:
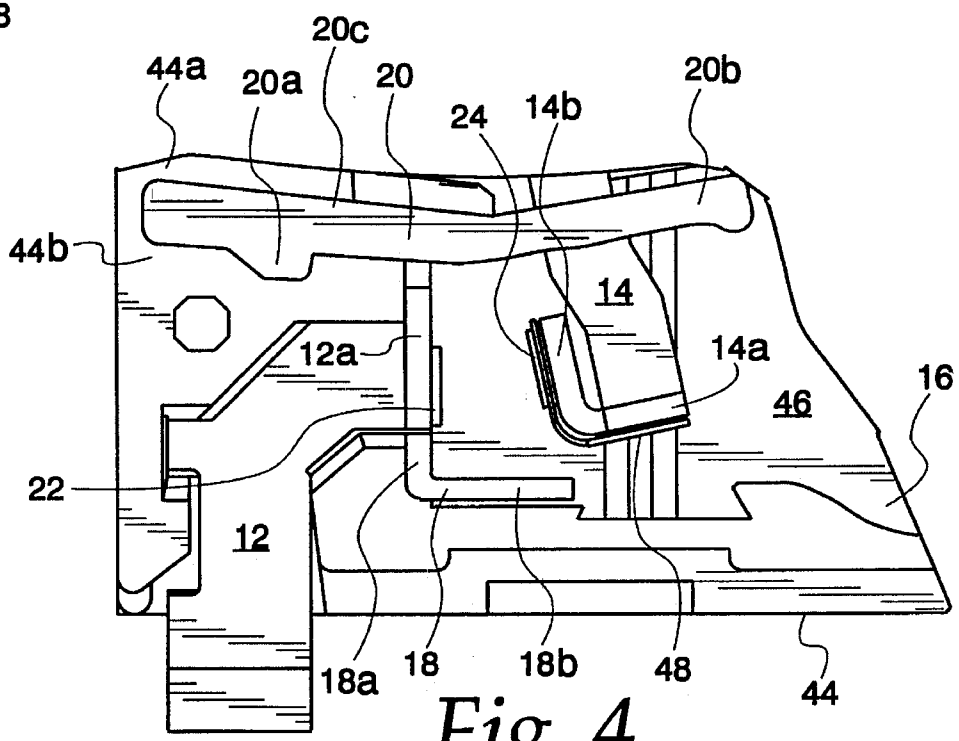
FIG. 4 is a top view of the contact carrier portion of the circuit breaker in FIG. 2 showing the movable contact carrier in an open (off/tripped) position.

As the trip lever 33 and its hook 36 rotate clockwise about the trip lever post 35, the toggle spring 34 rotates clockwise about the carrier hook 37. Rotation of the toggle spring 34 beyond its over-center position causes the movable contact carrier 14 to rotate counterclockwise to the open position (FIG. 4). The over-center position of the toggle spring 34 is defined by a line extending between the carrier hook 37 and a post 38 of a handle 39. As the movable contact carrier 14 rotates to the open position, the handle 39 is rotated clockwise about its post 38 to an off position by virtue of the engagement of the contact carrier leg 40 with a recess or notch 41 formed by the handle 39.

In a thermal trip the tripping mechanism operates in response to the current in the circuit breaker reaching a predetermined percentage (e.g., 135 percent) of the rated current for a period of time to be determined by calibration of the unit. This elevated current level causes direct heating of the bimetal 28, which results in the bending of the bimetal 28. The bimetal 28 is composed of two dissimilar thermostat materials which are laminated or bonded together and which expand at different rates due to temperature increases, thereby causing the bimetal 38 to bend. When the thermal-type overcurrent condition occurs, the bimetal 28 heats up and flexes counterclockwise about its connection 42 to the load terminal 26. Since both the yoke 30 and armature 31 are connected to the bimetal 28, the yoke 30 and armature 31 are carried with the bending bimetal 28. This causes the armature 31 to release its engagement of the trip lever 33. As described above in connection with magnetic tripping, the release of the trip lever 33 allows the toggle spring 34 to travel beyond its over-center position, causing the movable contact carrier 14 to rotate counterclockwise to the open position (FIG. 4).

Figure 3:
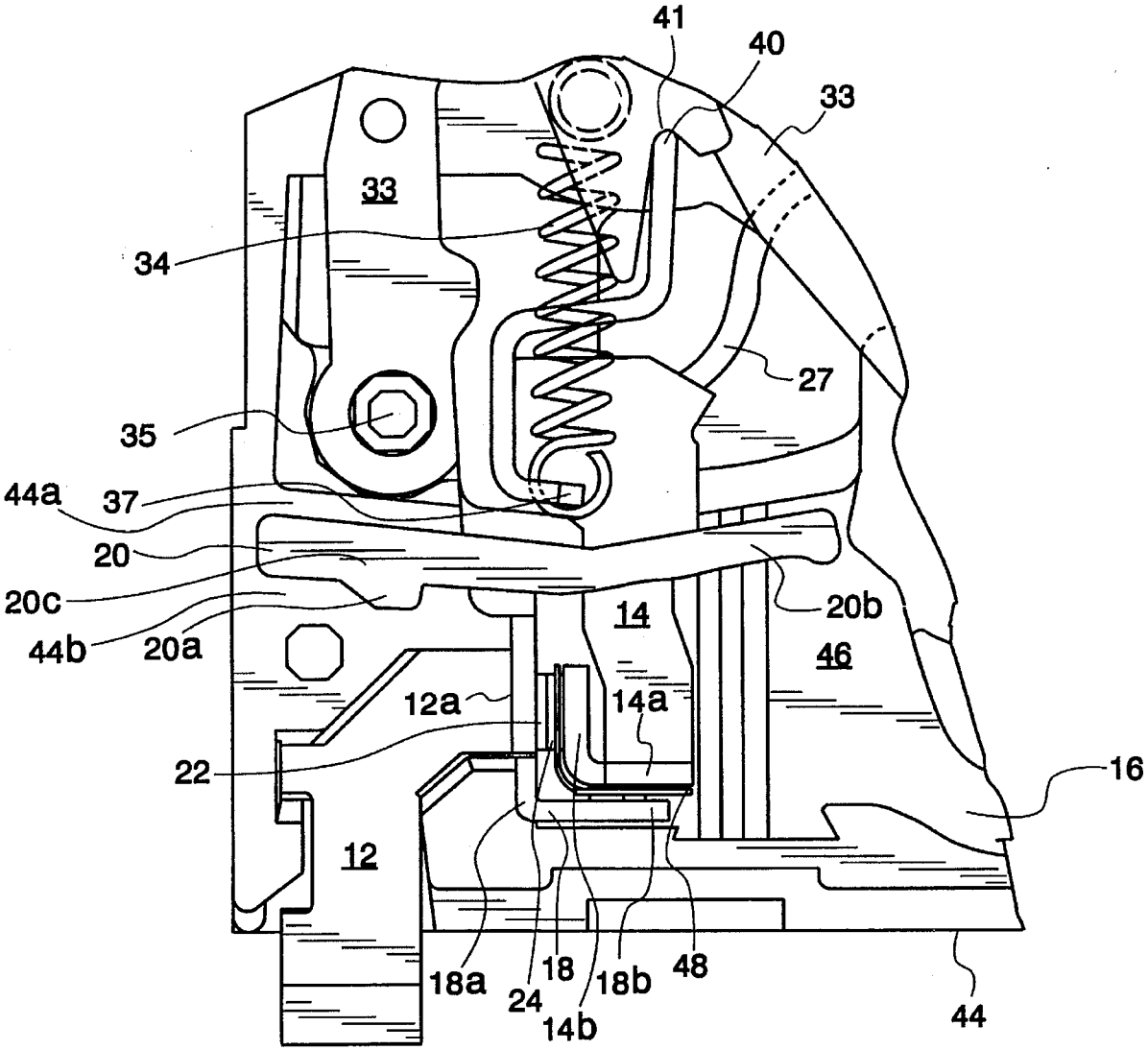
FIG. 3 is a top view of a contact carrier portion of the circuit breaker in FIG. 2 showing the movable contact carrier in a closed (on) position.

FIGS. 3 and 4 are enlarged top views of the contact carrier portion of the circuit breaker in FIGS. 1 and 2. FIG. 3 depicts the movable contact carrier 14 in its closed position, while FIG. 4 depicts the movable contact carrier 14 in its open position following a magnetic or thermal trip. The arc runner 18, the arc extinguishing barrier 20, and a protective shield 40 are constructed and arranged to protect the components of the circuit breaker from dangerous electrical arcs generated during circuit interruptions.

The L-shaped arc runner 18 includes a pair of planar legs **18*a* and 18*b* disposed perpendicular to each other. The leg 18*a* is generally parallel and adjacent to the stationary contact 22 and is preferably in contact with a stationary contact mounting surface 12*a* of the stationary contact carrier 12. If desired, the leg 18*a* may be attached to the stationary contact carrier 12 by means such as welding. The leg 18*b* is generally perpendicular to the stationary contact 22 and is generally parallel to a section 14a of the movable contact carrier 14. When the movable contact carrier 14 is in the closed position (FIG. 3), the legs 18*a* and 18*b* are generally parallel to a movable contact mounting section 14*b* and the section 14*a***, respectively.

With respect to the toggle spring 34, the arc runner 18 is located on an opposite side of the stationary and movable contacts 22 and 24 such that the contacts 22 and 24 are located generally between the arc runner 18 and the toggle spring 34. A base 44 and a cover (not shown) are constructed to secure the arc runner 18 in place within the circuit breaker 10. The arc runner 18 may be further held in place by attaching the are runner 18 to the mounting surface **12*a* of the stationary contact carrier 12**.

In the preferred embodiment, the arc runner 18 is composed of a conductive material such as steel, iron, copper, or conductive plastics. The thickness of the legs **18*a* and 18*b* is approximately 0.035 inches or 0.089 cm (as viewed in FIGS. 2–4). The transition from the leg 18*a* to the leg 18*b* is preferably curved. The length of the leg 18*b* is approximately 0.30 inches (0.76 cm), which is approximately twice the length of the leg 18*a***.

In response to the movable contact carrier 14 rotating to the open position (FIG. 4) during a circuit interruption, an electrical arc is generated between the stationary and movable contacts 22 and 24. To protect the stationary and movable contact carriers 12 and 14 and the toggle spring 34 from the electrical arc, the arc runner 18 draws the electrical arc away from the stationary and movable contacts 22 and 24 in a direction opposite to the toggle spring 34. To minimize damage to the face **12*a* of the stationary contact carrier 12, the shorter leg 18***a* of the arc runner 18 draws the electrical arc away from that face 12*a*. The arc runner 18 then directs the electrical arc toward the exhaust vent 16, which is located generally in line with the initial direction of movement of the movable contact 24 when the movable contact carrier 14 begins rotating from the closed position (FIG. 3) to the open position (FIG. 4).

Thus, the arc runner 18 does not allow the electrical arc to flow toward the toggle spring 34 or other nearby components of the tripping mechanism. Moreover, the arc runner 18 serves to protect the stationary and movable contact carriers 12 and 14 from damage such as erosion which can be caused by the electrical arc by minimizing their exposure to the electrical arc.

The arc extinguishing barrier 20 is an elongated piece of fibrous or thermoplastic outgassing material such as CYMEL™ molding compound, cellulose-based vulcanized fiber, nylon 6/6, DELRIN™ polyacetal, or melamine. The CYMEL™ molding compound is an alpha-melamine molding compound commercially available from AC Molding Compounds of Wallingford, Conn. The DELRIN™ polyacetal is commercially available from various manufacturers, including E. I. Du Pont de Nemours Co. of Wilmington, Del. An outgassing material is a material which releases adsorbed or occluded gases in response to being heated.

The barrier 20 is preferably mounted in the base 44 of the circuit breaker 10 between the toggle spring 34 and both the stationary and movable contacts 22 and 24. To secure the barrier 20 within the base 44, the base 44 preferably forms a pair of generally parallel walls 44*a* and 44*b* which snugly hold the barrier 20 therebetween. The walls 44*a* and 44*b* prevent the barrier 20 from shifting upward or downward as viewed in FIGS. 2–4. To prevent the barrier 20 from shifting to the right or left as viewed in FIGS. 2–4, the barrier 20 forms a projecting portion 20*a* which mates with a corresponding notch formed by the wall 44*b* of the base 44.

The barrier 20 is generally perpendicular to the planes of the stationary and movable contacts 22 and 24, and is generally parallel to both the section 14*a* of the movable contact carrier 14 and the leg 18*b* of the arc runner 18. As best shown in FIG. 1, the barrier 20 is generally perpendicular to and extends over the elongated body of the movable contact carrier 14. As viewed in FIGS. 2–4, a lower side of a central portion of the barrier 20 is located immediately adjacent to the stationary contact mounting surface 12*a*, while an upper side of the central portion of the barrier 20 is located in close proximity to the carrier hook 37 supporting one end of the toggle spring 34.

In the preferred embodiment, a fight section 20*b* of the barrier 20 has a generally uniform thickness of approximately 0.09 inches (0.23 cm). Without regard for the projecting portion 20*a*, a left section 20*c* of the barrier 20 has a thickness ranging from approximately 0.12 inches (0.30 cm) at its leftmost edge to approximately 0.10 inches (0.25 cm) at a location immediately above the stationary contact mounting surface 12*a*.

Conventional techniques for extinguishing arcs in circuit breakers include the use of a slide fiber connected to the movable contact carrier of the circuit breaker. Such a slide fiber is disadvantageous because it is prone to impeding the movement of the movable contact carrier to which it is connected. Moreover, the slide fiber has a tendency to break during endurance testing. Contrary to conventional slide fibers, the arc extinguishing barrier 20 is a non-moving part which is not connected to the movable contact carrier 14. Thus, the barrier 20 does not break during endurance testing and is less prone to impeding the movement of the movable contact carrier 14.

When the movable contact carrier 14 rotates from the closed position (FIG. 3) to the open position (FIG. 4) during a circuit interruption, the arc extinguishing barrier 20 prevents the electrical arc generated between the stationary and movable contacts 22 and 24 from passing out of the arc chamber 46 and into the portion of the base 44 containing the toggle spring 34. Rather, the barrier 20 assists in extinguishing the arc generated during contact separation. Specifically, the arc heats up the outgassing material of the barrier 20 to cause that outgassing material to release gas into the arc chamber 46. The released gas increases the pressure in the arc chamber 46 to cool the arc and assists the arc runner 18 in leading the arc to the exhaust vent 16. Since the barrier 20 is in close proximity to the stationary and movable contacts 22 and 24, the barrier 20 provides optimum protection to the stationary and movable contact carriers 12 and 14 and their respective contacts.

Figure 5C:
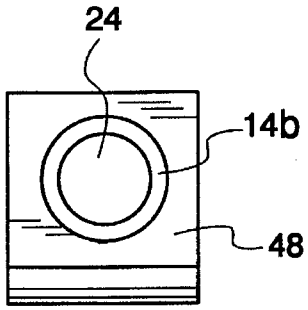
FIG. 5*c* is a front view of a contact mounting section of the movable contact carrier in FIGS. 5*a* and 5*b*.
Figure 5A:
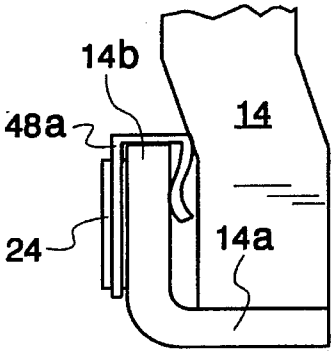
FIG. 5*a* is a top view of the movable contact carrier with a protective shield mounted thereto.
Figure 5B:
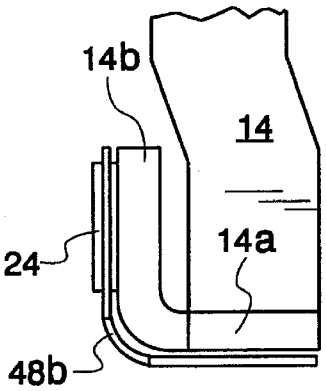
FIG. 5*b* is a top view of the movable contact carrier with a modified protective shield mounted thereto.

To enhance current flow through the circuit breaker 10, the movable contact carrier 14 is typically composed of a highly conductive material such as copper. While copper is preferred for boosting current flow, copper is susceptible to being eroded, melted, or vaporized if exposed to an electrical arc generated during a circuit interruption. To minimize exposure of the movable contact carrier 14 to the electrical arc, a protective shield 48 is preferably mounted to the movable contact carrier 14 in the area of the contact 24. FIGS. 5*a*–5*b* depict two types of protective shields 48 which may be employed with the movable contact carrier 14.

In FIG. 5*a*, a U-shaped protective shield 48*a* is physically fastened to the mounting section 14*b* of the movable contact carrier 14 by snapping or clipping the shield 48*a* over the mounting section 14*b*. The shield 48*a* is preferably composed of a heat-resistant conductive metal such as steel or iron having a melting point greater than approximately 2000° F., and the thickness of the shield 48*a* is selected to be in a range from about 0.025 inches (0.064 cm) to about 0.035 inches (0.089 cm). The shield 48*a* is manufactured using conventional stamping techniques.

In FIG. 5*b*, an L-shaped protective shield 48*b* is adhered to both the mounting section 14*b* and the adjacent section 14*a*. In one embodiment, the shield 48*b* is composed of a conductive metal such as steel or iron having a melting point greater than approximately 2000° F., and the thickness of the shield 48*b* is selected to be in a range from about 0.025 inches (0.064 cm) to about 0.035 inches (0.089 cm). In this case the shield 48*b* is preferably welded to the movable contact carrier 14.

In an alternative embodiment, the shield 48*b* is composed of a flexible, self-adhesive thermoset material such as silicone, melamine, polytetrafluoroethylene (PTFE) coated glass, cloth, polyimide, or TEFLON. Like the conductive metal described above, the thermoset material has a melting point greater than approximately 500° F. so that the shield 48*b* is resistant to the high temperatures which can develop in the are chamber 46. The thickness of the self-adhesive shield 48*b* (as viewed in FIG. 5*b*) is selected to be in a range from about 0.010 inches (0.025 cm) to about 0.020 inches (0.051 cm). To provide the movable contact carrier 14 with the shield 48*b*, the shield 48*b* is stamped out of a uniform sheet of self-adhesive material and is then adhered to the sections 14*a* and 14*b* of the movable contact carrier 14. Since the shield 48*b* is created from the uniform sheet, one can be assured that the shield 48*b* has the same thickness throughout. In contrast, prior techniques have provided the movable contact carrier 14 with a conformal coating of silicone by dipping the carrier 14 into liquid silicone and allowing the coating of silicone to cure. Such a conformal coating is disadvantageous because it might not be applied uniformly to the surface of the carrier 14. Rather, the coating may be thicker at some locations than at other locations.

The protective shield 48 is manufactured to conform to the shape and geometry of the sections of the movable contact carrier 14 to which it is mounted. As best shown in FIG. 5*c*, the shield 48 is provided with a circular aperture to accommodate the movable contact 24. The shield 48 is mounted to the movable contact carrier 14 in such a manner as to adequately cover the area of the movable contact carrier 14 which is ordinarily exposed to an electrical are during circuit interruption, i.e., the area surrounding the movable contact 24 on the mounting section 14*b*.

The protective shield 48 minimizes exposure of the movable contact carrier 14 to the electrical arc during circuit interruption by shielding the carrier 14 from the arc and redirecting the arc away from the carrier 14. The shield 48 substantially prevents the electrical arc from coming in contact with the movable contact carrier 14, thereby preventing erosion and potential failure of the carrier 14 due to an excessive reduction in cross-sectional area. By preventing erosion of the movable contact carrier 14, the protective shield 48 increases the useful life of the circuit breaker 10. Furthermore, an important advantage of the protective shield 48 is that it provides a visual confirmation to an operator that the shield has been installed on the movable contact carrier 14 so that the carrier 14 is adequately protected from an electrical arc. With respect to prior techniques of forming a conformal coating on the carrier 14, such visual confirmation does not exist because the conformal coating is not readily observable by an operator.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An arrangement in an electrical switching device for protection against electrical arcs, comprising:

a stationary contact carrier having a stationary contact mounted thereon;

a movable contact carrier having a movable contact mounted thereon, said movable contact carrier being movable between a closed position and an open position, said movable contact abutting said stationary contact while said movable contact carrier is in said closed position, said movable contact being separated from said stationary contact while said movable contact carrier is in said open position;

a tripping mechanism having a toggle spring coupled to said movable contact carrier, said tripping mechanism causing said movable contact carrier to move from said closed position to said open position in response to an overcurrent condition;

an arc runner positioned such that said arc runner and said toggle spring are generally located on opposite sides of said stationary contact;

an arc extinguishing barrier composed of an outgassing material and located between said stationary contact and said toggle spring; and an arc-resistant protective shield mounted to said movable contact carrier and surrounding said movable contact, said protective shield being composed of a flexible, self-adhesive material and adhered to said movable contact carrier.

2. The arrangement of claim 1, wherein said flexible, self-adhesive material is selected from the group consisting of silicone, melamine, polytetrafluoroethylene (PTFE) coated glass, cloth, polyimide, and TEFLON.

* * * * *